US010151234B2

(12) United States Patent
Kishimoto et al.

(10) Patent No.: US 10,151,234 B2
(45) Date of Patent: Dec. 11, 2018

(54) OUTBOARD MOTOR

(71) Applicant: SUZUKI MOTOR CORPORATION, Hamamatsu-Shi, Shizuoka (JP)

(72) Inventors: Morio Kishimoto, Hamamatsu (JP); Saki Nozue, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/786,175

(22) Filed: Oct. 17, 2017

(65) Prior Publication Data

US 2018/0163611 A1 Jun. 14, 2018

(30) Foreign Application Priority Data

Dec. 14, 2016 (JP) ..... 2016-242020

(51) Int. Cl.

| | |
|---|---|
| ***B63B 13/00*** | (2006.01) |
| ***F01P 3/20*** | (2006.01) |
| ***F02B 61/04*** | (2006.01) |
| ***F01P 11/02*** | (2006.01) |
| ***B63H 20/00*** | (2006.01) |
| ***B63H 20/32*** | (2006.01) |
| ***B63H 21/38*** | (2006.01) |
| ***F01P 11/06*** | (2006.01) |
| *B63H 21/14* | (2006.01) |
| *F01P 7/14* | (2006.01) |

(52) U.S. Cl.

CPC ..... *F01P 11/0276* (2013.01); *B63H 20/00* (2013.01); *B63H 20/32* (2013.01); *B63H 21/38* (2013.01); *F01P 11/02* (2013.01); *F01P 11/06* (2013.01); *F01P 7/14* (2013.01); *F02B 61/045* (2013.01)

(58) Field of Classification Search

CPC ..... B63H 20/28; F01P 11/02; F01P 11/0276; F01P 61/045

USPC ..... 440/88 C, 88 D, 88 G, 88 J, 88 N

See application file for complete search history.

(56) References Cited

U.S. PATENT DOCUMENTS

| | | | | |
|---|---|---|---|---|
| 5,634,833 A * | 6/1997 | Watanabe | F01P 3/202 | 440/113 |
| 5,715,777 A | 2/1998 | Wada et al. | | |
| 5,873,330 A * | 2/1999 | Takahashi | F01N 3/043 | 123/195 P |
| 5,934,957 A * | 8/1999 | Sato | F01M 5/002 | 440/88 J |
| 6,109,987 A * | 8/2000 | Watanabe | F01P 3/205 | 134/166 R |

(Continued)

FOREIGN PATENT DOCUMENTS

JP H08312346 A 11/1996

*Primary Examiner* — Daniel V Venne
(74) *Attorney, Agent, or Firm* — Troutman Sanders

(57) ABSTRACT

An outboard motor includes a water jacket provided in a water-cooled engine, a first channel configured to allow a downstream-side end of a coolant flow of the water jacket to communicate with the external air, a thermo-valve provided between a downstream-side end of the coolant flow of the water jacket and an upstream-side end of the coolant flow of the first channel, a second channel configured to allow an upstream side of the coolant flow of the thermo-valve to communicate with the external air, and a second valve configured to open or close a second channel.

7 Claims, 10 Drawing Sheets

(56) References Cited

U.S. PATENT DOCUMENTS

| | | | | |
|---|---|---|---|---|
| 6,551,154 | B1 * | 4/2003 | Jaszewski | F01P 3/205<br>440/2 |
| 6,561,140 | B2 * | 5/2003 | Nagashima | F01P 3/202<br>123/41.08 |
| 6,675,749 | B2 * | 1/2004 | Osakabe | F01P 3/202<br>123/41.31 |

* cited by examiner

OUTBOARD MOTOR

CROSS-REFERENCE TO RELATED APPLICATIONS

This application is based upon and claims the benefit of priority of the prior Japanese Patent Application No. 2016-242020, filed on Dec. 14, 2016, the entire contents of which are incorporated herein by reference.

FIELD OF THE INVENTION

The present invention relates to an outboard motor.

BACKGROUND

An outboard motor having a water-cooled engine collects water of a river or lake or seawater from the outside and uses it as an engine coolant. After the use, the coolant remaining in a water jacket of the engine is discharged.

Japanese Laid-open Patent Publication No. 8-312346 discusses an engine including a water jacket provided in an engine block, a first coolant passage connected to an upstream side of a coolant flow direction of the water jacket, a second coolant passage connected to a downstream side of the coolant flow direction of the water jacket, a coolant pump that supplies the coolant to the first coolant passage, and a thermo-valve provided in the second coolant passage, wherein a relief valve for bypassing the coolant from the first coolant passage to the second coolant passage is provided in a bypass passage that connects the first coolant passage to a downstream position of the coolant flow direction relative to the thermo-valve of the second coolant passage, and a flushing water inlet portion is provided in the second coolant passage between the water jacket and the thermo-valve.

In order to discharge the coolant remaining in the water jacket of the engine after an operation stop, it is necessary to exchange the water remaining in the water jacket with the external air. However, in the configuration discussed in Japanese Laid-open Patent Publication No. 8-312346, if a temperature of the coolant decreases after the operation stop, the thermo-valve provided in the downstream side of the water jacket is closed. Therefore, the second coolant passage is closed. For this reason, a long time is necessary to exchange the coolant remaining in the water jacket with the external air.

SUMMARY

In view of the aforementioned problems, it is therefore an object of the present invention to provide an outboard motor capable of rapidly discharging the coolant remaining in the water jacket after an engine operation stop.

In order to address the aforementioned problems, there is provided an outboard motor including: a water jacket provided in a water-cooled engine to allow a coolant to flow through; a first channel configured to allow a downstream-side end of the coolant flow of the water jacket to communicate with external air; a first valve provided between a downstream-side end of the coolant flow of the water jacket and an upstream-side end of the coolant flow of the first channel, the first valve having a closed position when a temperature of the coolant is lower than a predetermined level and having an open position when the temperature of the coolant is equal to or higher than the predetermined level; a second channel configured to allow an upstream side of the coolant flow of the first valve to communicate with the external air; and a second valve configured to open or close the second channel.

DETAILED DESCRIPTION

Embodiments of the present invention will now be described in details with reference to the accompanying drawings. In each drawing, the arrow "Fr" indicates a front side (forward direction) of the outboard motor, the arrow "Rr" indicates a rear side (backward direction), the arrow "Up" indicates an upper side, and the arrow "Dn" indicates a lower side as necessary.

Figure 1:
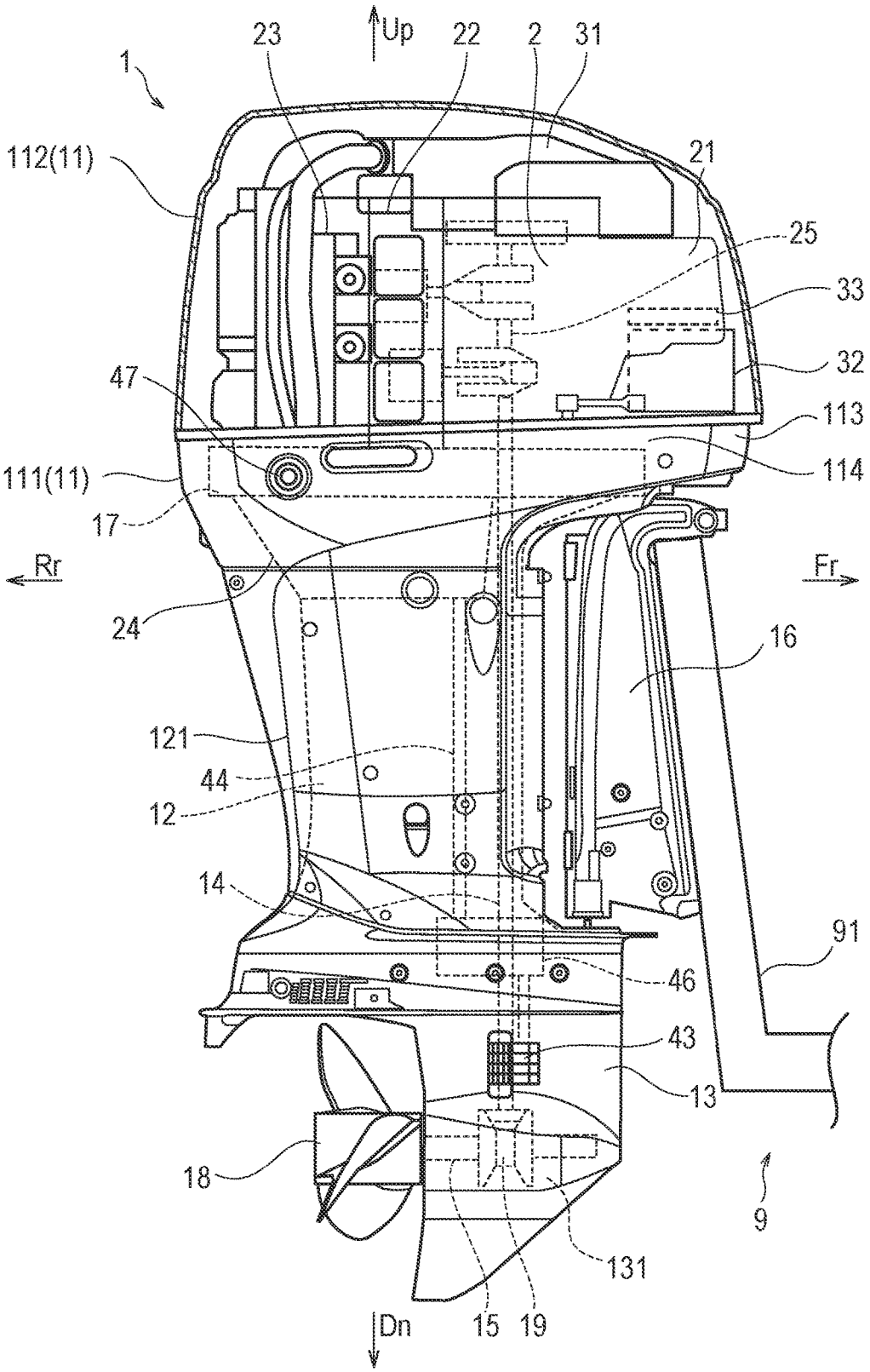
FIG. 1 is a right side view schematically illustrating an exemplary configuration of an outboard motor according to an embodiment of the invention.
Figure 2:
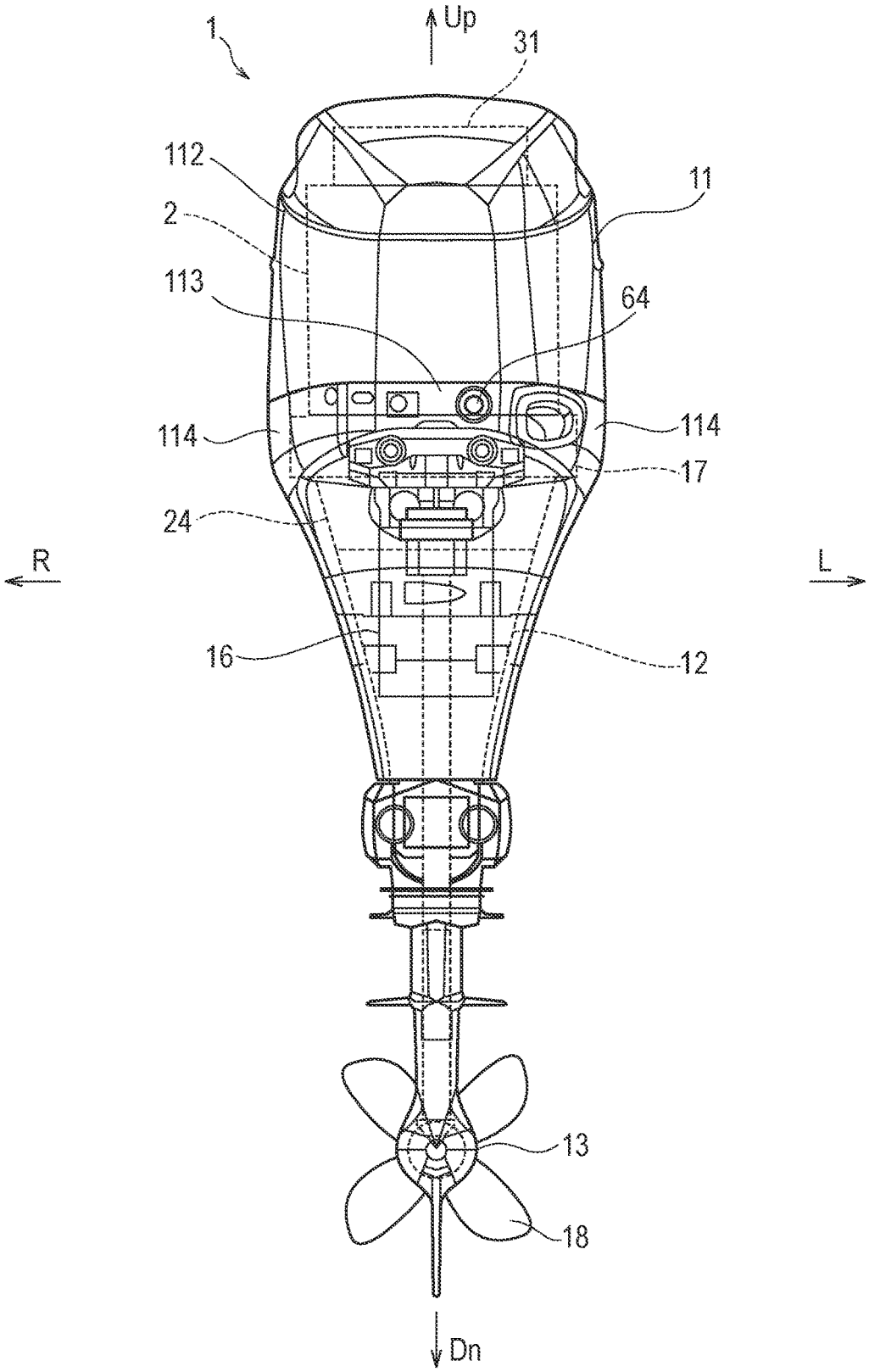
FIG. 2 is a front view schematically illustrating an exemplary configuration of the outboard motor according to the embodiment of the invention.

First, an exemplary configuration of the entire outboard motor 1 according to an embodiment of the invention will be described with reference to FIGS. 1 and 2. FIG. 1 is a right side view schematically illustrating an exemplary configuration of the outboard motor 1 according to an embodiment of the invention. FIG. 2 is a front side view schematically illustrating an exemplary configuration of the outboard motor 1 according to an embodiment of the invention. The outboard motor 1 according to an embodiment of the invention is mounted on, for example, a transom 91 of a boat 9 (refer to FIG. 1).

The outboard motor 1 includes an engine unit 2 provided in the uppermost part, an engine holder 17 and an oil pan 24 provided under the engine unit 2, a driveshaft housing 12 provided under the engine holder 17 and the oil pan 24, and a gear housing 13 provided under the driveshaft housing 12. The engine holder 17, the oil pan 24, the driveshaft housing 12, and the gear housing 13 are formed of a metal material such as aluminum alloy, for example, through molding (for example, die casting) or the like. The engine unit 2, the engine holder 17, the oil pan 24, and the driveshaft housing 12 have a casing including an engine cover 11 provided in the uppermost part and a driveshaft housing cover 121 provided thereunder. The engine cover 11 and the driveshaft housing cover 121 are formed of, for example, a resin material through injection molding or the like. A thrust propeller 18 is provided in rear of the gear housing 13. In addition, a mount device 16 for mounting the outboard motor 1 on the transom 91 of the boat 9 or the like is provided in front of the casing of the outboard motor 1 (particularly, in front of the engine cover 11 and the driveshaft housing cover 121).

The engine cover 11 has a lower engine cover 111 and an upper engine cover 112. In addition, the upper engine cover 112 is installed over the lower engine cover 111 so as to form the engine cover 11. A front panel 113 is provided in a front face side of the lower engine cover 111, and a side panel 114 is provided in a lateral face side of the lower engine cover 111. In this manner, the lower engine cover 111 includes the front panel 113 and the side panel 114. The upper engine cover 112 has a domical shape opened downward. Furthermore, if the upper engine cover 112 is installed over the lower engine cover 111, a space for housing the engine unit 2 or the generator 31 is formed inside the engine cover 11.

A water-cooled engine (internal combustion engine) is employed in the engine unit 2 serving as a driving force source of the outboard motor 1. In addition, a vertical type engine unit in which an axial line of the crankshaft 25 as a rotary power output shaft is aligned vertically is employed in the engine unit 2. The engine unit 2 has a crankcase 21, a cylinder block 22, a cylinder head 23, and an oil pan 24. In addition, the engine unit 2 is housed in the engine cover 11 such that the crankcase 21 is located in the frontmost side, the cylinder block 22 is located in rear of the crankcase 21, a cylinder head 23 is located in rear of the cylinder block 22, and the oil pan 24 is located thereunder. Furthermore, the engine unit 2 is supported by the engine holder 17 while it is housed in the engine cover 11.

A water jacket 45 where a coolant for cooling the cylinder block 22 or the cylinder head 23 can flow through is provided in the cylinder block 22 or the cylinder head 23 of the engine unit 2. An inlet port 451 of the water jacket 45 (an upstream-side end of the coolant flow direction) is provided in a lower side (lower face) of the engine unit 2, and an outlet port 452 (an upstream-side end of the coolant flow) is provided in the upper side (upper face) of the engine unit 2. In this manner, the outlet port 452 of the water jacket 45 is provided in the upper side relative to the inlet port 451.

A generator 31 is provided in the upper side of the engine unit 2. The generator 31 is operated to generate electricity by virtue of rotation of the crankshaft 25 of the engine unit 2. For example, the crankshaft 25 of the engine unit 2 protrudes upward from the crankcase 21, and the generator 31 is connected to this upward protruding portion. The power generated by the generator 31 is supplied to each part of the outboard motor 1 and is charged in a battery 32.

The engine holder 17 is a member for supporting the engine unit 2. Nearly the entire part of the engine holder 17 is housed in the engine cover 11, and a frontmost part protrudes (is exposed) to the front side of the engine cover 11.

The driveshaft 14 is rotatably housed in the driveshaft housing 12 and is rotatably supported by a shaft receptacle such as a bearing. The driveshaft has an axial line (rotation center line) provided in parallel with a vertical direction. An upper end of the driveshaft 14 is connected to the crankshaft 25 of the engine unit 2, and a lower end is connected to a shift mechanism 19. In addition, the driveshaft 14 transmits rotational power output from the engine unit 2 to the propeller shaft 15 through the shift mechanism 19.

A shift mechanism chamber 131 is provided inside the gear housing 13. The shift mechanism chamber 131 houses the shift mechanism 19 and rotatably houses the propeller shaft 15. The shift mechanism chamber 131 is opened in the rear side. Note that a rear part of the shift mechanism chamber 131 serves as a part of an exhaust channel for discharging an exhaust gas of the engine unit 2 to the outside.

The shift mechanism 19 connects or disconnects rotational power transmitted from the driveshaft 14 to the propeller shaft 15 and switches the rotational direction. Note that the configuration of the shift mechanism 19 is not particularly limited, and various types of configurations known in the art may be employed. The thrust propeller 18 is provided in the rear end of the propeller shaft 15 using a shear pin or the like such that it is rotated in synchronization with the propeller shaft 15.

The outboard motor 1 is provided with a water intake port 43, a water intake channel 44, and a water pump 46 for collecting water of a sea, river, or lake from the outside as a coolant of the engine unit 2 and feeding the water to the engine unit 2. The water intake port 43 is provided in a position submerged during the operation of the outboard motor 1 on both side faces of the gear housing 13. The water intake channel 44 is a channel for feeding the coolant obtained (suctioned) from the water intake port 43 to the engine unit 2. The water intake channel 44 connects the water intake port 43 provided in the gear housing 13 and the inlet port 451 of the water jacket 45 provided in the engine unit 2 such that the coolant can flow therethrough. The water pump 46 is provided in the middle of the water intake channel 44 and is operated by virtue of rotation of the driveshaft 14. For this reason, the water pump 46 is continuously operated during the operation of the engine unit 2 to obtain the coolant. Note that the water pump 46 is provided in the water intake channel 44 such that it is interposed between a portion where the water intake channel 44 is provided in the gear housing 13 is provided and a portion where the water intake channel 44 is provided in the driveshaft housing 12 is provided. In this case, the water pump 46 is provided in the vicinity of or across a boundary between the driveshaft housing 12 and the gear housing 13 as seen in a side view.

In addition, the outboard motor 1 is provided with an exhaust channel for discharging an exhaust gas of the engine unit 2 to the outside and a first channel 41 for discharging the coolant flowing through the water jacket 45 of the engine unit 2 to the outside. The exhaust channel is provided to vertically extend across the inside of the driveshaft housing 12. For example, the upper end of the exhaust channel is connected to a muffler provided inside the engine cover 11, and the lower end communicates with the shift mechanism chamber 131 provided in the gear housing 13. The first channel 41 allows the outlet port 452 of the water jacket 45 of the engine unit 2 to communicate with the external air (the outside of the outboard motor) such that the coolant or flushing water (described below) can flow therethrough. The upstream-side end of the coolant flow of the first channel 41 is connected to the outlet port 452 of the water jacket 45 of the engine unit 2 through the valve housing 5 described below. A downstream-side end of the coolant flow of the first channel 41 communicates with the exhaust channel or the shift mechanism chamber 31 provided in the gear housing 13. In addition, the downstream-side end of the coolant flow of the first channel 41 communicates with the atmosphere (opened to the atmosphere) inside the exhaust channel or the shift mechanism chamber 131. Note that various types of hoses or tubes may be employed in the first channel 41.

The mount device 16 is a device for mounting the outboard motor 1 on the boat 9. The mount device 16 is provided in the engine cover 11 which is the casing of the outboard motor 1 and a front side of the driveshaft housing cover 121. The mount device 16 has, for example, a swivel bracket and a transom bracket. The swivel bracket is connected to the front side of the outboard motor 1 through a pilot shaft such that it can rotate in the left-right direction relative to the casing of the outboard motor 1. The transom bracket is connected to the swivel bracket through a tilt shaft such that it can rotate in a vertical direction (pitching direction) relative to the swivel bracket. In addition, a clamp for mounting the outboard motor 1 to the transom 91 of the boat 9 is provided in the transom bracket. As a result, the outboard motor 1 can be steered in the left-right direction with respect to the pilot shaft while it is mounted on the transom 91 of the boat 9 and can be trimmed or tilted by interposing the tilt shaft. Note that the mount device 16 may have any configuration without a particular limitation as long as the outboard motor 1 can be mounted on the boat 9.

In addition, the outboard motor 1 has an engine control unit (ECU) 33 and a battery 32 as an external power source. The battery 32 is charged with electric power generated from the generator 31 and supplies the charged power to each part (each device) of the outboard motor 1. The ECU 33 (Engine Control Unit) is operated by the power supplied from the battery 32 to control each part (each device) of the outboard motor 1. The ECU 33 includes a computer provided with a central processing unit (CPU), a read-only memory (ROM), and a random access memory (RAM). The ROM of the computer of the ECU 33 stores a computer program for controlling each part of the outboard motor 1 in advance. In addition, the CPU of the computer of the ECU 33 reads this computer program from the ROM and executes it by using the RAM as a work area. As a result, a control of each part of the outboard motor 1 is implemented.

As illustrated in FIG. 2, a drain manipulation portion 64 is provided in the front panel 113 of the lower engine cover 111. The drain manipulation portion 64 is provided to perform a manipulation for discharging the coolant remaining in the water jacket (hereinafter, referred to as "remaining water" for convenient description purposes) to the outside of the outboard motor 1 (hereinafter, referred to as a "drain manipulation"). A configuration of the drain manipulation portion 64 will be described below.

In addition, a flushing water injection port 75 is provided on an outer circumferential surface of the engine cover 11, the driveshaft housing cover 121, or the gear housing 13. The flushing water injection port 75 is a part for injecting flushing water from the outside to rinse the inside of the water jacket 45 of the engine unit 2 (hereinafter, referred to as "flushing"). The flushing water injection port 75 and the water intake channel 44 are connected to each other such that the flushing water can flow through the flushing water channel 73. Note that the flushing water channel 73 is connected to the water intake channel 44 in the downstream side of the coolant flow relative to the water pump 46. In addition, a lid member 74 (splash cap) is detachably installed in the flushing water injection port 75 so that the flushing water channel 75 is maintained in a closed state by the lid member 74 except for the flushing.

Cooling System of Engine Unit

Figure 3:
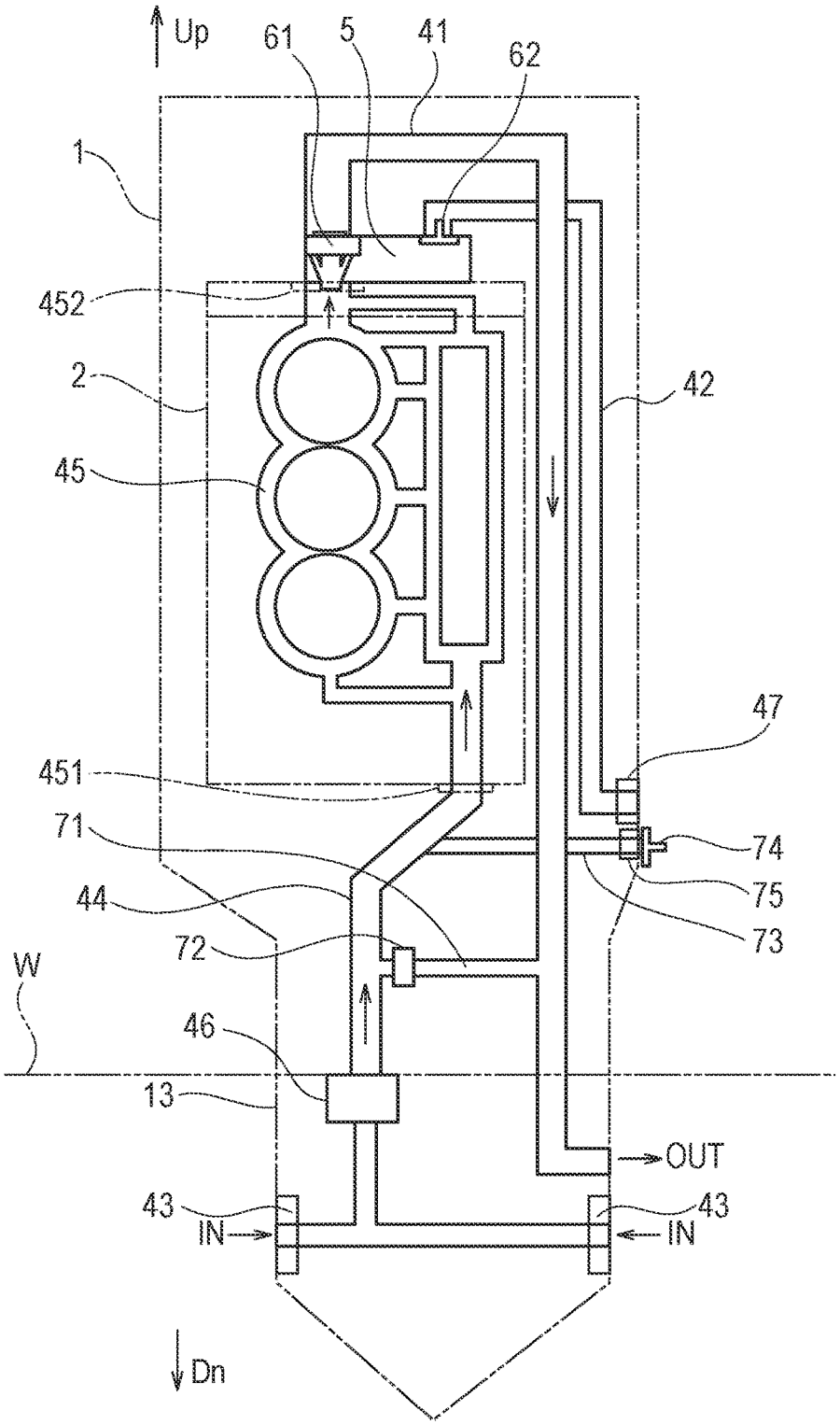
FIG. 3 is a schematic diagram illustrating an exemplary configuration of a cooling system of an engine unit.

Next, a first exemplary configuration and operation of the cooling system of the engine unit 2 will be described. FIG. 3 is a schematic diagram illustrating a first exemplary configuration of the cooling system of the engine unit 2. Note that the arrow of FIG. 3 indicates a direction of the coolant flow during the operation of the engine unit 2. In addition, the reference sign "W" schematically indicates an approximate water surface (this similarly applies to FIG. 10).

As illustrated in FIG. 3, the water intake port 43 provided in the gear housing 13 and the inlet port 451 of the water jacket 45 of the engine (upstream-side end of the coolant flow) are connected to each other through the water intake channel 44. In addition, the water intake channel 44 is provided with a water pump 46 operated by virtue of rotation of the driveshaft 14. For this reason, during the operation of the engine unit 2 (during rotation of the driveshaft 14), the water pump 46 is operated so that the coolant is obtained (suctioned) from the outside through the water intake port 43, and the obtained coolant is fed to the water jacket 45 of the engine unit 2. Note that the configuration of the water pump 46 is not particularly limited, and various types of water pumps known in the art may be employed.

The valve housing 5 is provided in the outlet port 452 of the water jacket 45 of the engine unit 2 (in the downstream-side end of the coolant flow). The valve housing 5 houses the first valve 61 and the second valve 62 and are connected to each end of the first and second channels 41 and 42. Note that, as illustrated in FIG. 3, the first channel 41 is connected so as to communicate with the first valve 61, and the second channel 42 is connected so as to communicate with the second valve 62. In other words, the first channel 41 is opened or closed by the first valve 61, and the second channel 4 is opened or closed by the second valve 62. Furthermore, the first and second valves 61 and 62 are provided in parallel with each other. Note that, for example, various types of hoses or tubes may be employed in the second channel 42.

The first channel 41 is a channel for discharging the coolant flowing from the outlet port 452 of the water jacket 45 of the engine unit 2 to the outside of the outboard motor 1. The upstream-side end of the coolant flow of the first channel 41 is connected to valve housing 5, and the downstream-side end communicates with the external air (opened to the atmosphere). For example, the downstream-side end of the coolant flow of the first channel 41 is provided inside the shift mechanism chamber 131 of the gear housing 13. The shift mechanism chamber 131 is an area where the rear side is opened and communicates with the external air. For this reason, the downstream-side end of the coolant flow of the first channel 41 communicates with the external air inside the shift mechanism chamber 131 of the gear housing 13. However, the position where the downstream-side end of the coolant flow of the first channel 41 is provided is not limited to the inside of the shift mechanism chamber 131 of the gear housing 131. The downstream-side end of the coolant flow of the first channel 41 may be provided in any position as long as the coolant can be discharged to the outside of the outboard motor 1.

The second channel 42 is a channel for introducing the air to the inside of the water jacket 45 of the engine unit 2 when the remaining water is discharged to the outside of the outboard motor 1. The downstream-side end of the air flow of the second channel 42 is connected to the valve housing 5. The upstream-side end of the air flow is connected to the air intake portion 47 provided in the engine cover 11 and communicates with the external air through the air intake portion 47. In this manner, the second channel 42 connects the water jacket 45 of the engine unit 2 and the outside of the outboard motor 1 to each other through the second valve 62 of the valve housing 5 such that the air can flow. In addition, in the event of flushing, the flushing water is discharged to the outside of the outboard motor 1 through the second channel 42 and the air intake portion 47. That is, the second channel 42 is also used as a channel for discharging the flushing water to the outside of the outboard motor 1 in the event of flushing.

Note that, although the valve housing 5 is interposed between the outlet port 452 of the water jacket 45 of the engine unit 2 and the first and second channels 41 and 42 in this embodiment, the present invention is not limited to such a configuration. For example, the upstream-side end of the coolant flow of the first channel 41 may be connected to the outlet port 452 of the water jacket 45 of the engine unit 2. In this case, the valve housing 5 may be provided in the middle of the first channel 41, and the downstream-side end of the air flow of the second channel 42 may be connected in the middle of the first channel 41 through the valve housing 5.

A valve switched to the open position at a predetermined coolant temperature or higher and to the closed position under a predetermined coolant temperature may be employed in the first valve 61. A thermo-valve (thermostat) may be employed as such a valve. Note that a temperature at which the first valve 61 is switched from the closed position to the open position is set to a coolant temperature at which a warm-up operation of the engine unit 2 is completed. A specific temperature is appropriately set depending on a configuration of the engine unit 2 or the like. In addition, a configuration of the thermo-valve used as the first valve 61 is not particularly limited, and various types of thermo-valves known in the art may be employed.

The second valve 62 is in the closed position during the use of the outboard motor 1 (during the operation of the engine unit 2) and is switched to the open position when the remaining water is discharged. Note that an exemplary configuration of the second valve 62 will be described below.

The outboard motor 1 is provided with a relief channel 71 that connects the water intake channel 44 and the first channel 41 so as to flow the coolant and a relief valve 72 that opens or closes the relief channel 71. The relief channel 71 is provided to branch from a path between the water pump 46 and the inlet port 451 of the water jacket 45 of the engine unit 2 to the first channel 41. The relief valve 72 is a normally closed valve. The relief valve 72 maintains the closed position while an internal pressure of the water intake channel 44 is lower than a predetermined level. The relief valve 72 has the open position when the internal pressure of the water intake channel 44 increases to a predetermined level or higher.

As illustrated in FIG. 3, the flushing water injection port 75 and the water intake channel 44 are connected to each other through the flushing water channel 73. A lid member 74 (flush cap) is detachably installed in the flushing water injection port 75 so that the flushing water injection port 75 is closed by the lid member 74 while the flushing is not performed.

Here, the operation of the cooling system of the engine unit 2 will be described.

As the operation of the engine unit 2 starts, and the crankshaft 25 is rotated, the rotation of the crankshaft 25 is transmitted to the driveshaft 14, and the water pump 45 starts to operate by virtue of the rotation of the driveshaft 14. For this reason, water from the outside of the outboard motor 1 is obtained (suctioned) from the water intake port 43 as a coolant of the engine unit 2 and is fed to the water jacket 45 of the engine unit 2 through the water intake channel 44.

While the warm-up operation is not completed after the operation start of the engine unit 2, the temperature of the cylinder block 22 of the engine unit 2 is low. Therefore, the coolant flowing to the valve housing 5 through the water jacket 45 also has a low temperature. If the coolant flowing to the inside of the valve housing 5 has a temperature lower than a predetermined level, the first valve 61 maintains the closed position. In addition, the second valve 62 maintains the closed position during the operation of the engine unit 2. For this reason, while the warm-up operation of the engine unit 2 is not completed, the coolant does not flow to any one of the first and second channels 41 and 42, and is detained in the water intake channel 44, the water jacket 45, and the inside of the valve housing 5, so that the warm-up operation of the engine unit 2 is promoted.

If the warm-up operation is completed after the operation of the engine unit 2 starts, and a predetermined time elapses, the temperature of the coolant detained in the water jacket 45 and the inside of the valve housing 5 increases due to the heat of the cylinder block 22 of the engine unit 2. In addition, if the temperature of the coolant detained in the inside of the valve housing 5 increases to a predetermined temperature or higher, the first valve 61 has the open position. In this state, the coolant inside the valve housing 5 flows to the first channel 41 through the first valve 61 and is discharged to the outside of the outboard motor 1 through the first channel 41. In this manner, the coolant does not flow until the completion of the warm-up operation of the engine unit 2. Instead, the coolant flows as the warm-up operation is completed. Note that, since the second valve 62 is in the closed position, the coolant flowing through the water jacket 45 does not flow to the second channel 42.

Note that, if the downstream-side end of the coolant flow of the first channel 41 is provided inside the exhaust channel, the coolant of the engine unit 2 is discharged to the outside of the outboard motor 1 through the exhaust channel. If the coolant of the engine unit 2 is discharged to the inside of the exhaust channel, the exhaust gas of the engine unit 2 is cooled by the coolant. In this configuration, it is possible to reduce an exhaust sound. Furthermore, in a case where the internal pressure of the water intake channel 44 becomes equal to or higher than a predetermined level, the relief valve 72 is switched from the closed position to the open position. For this reason, in this case, a part of the coolant fed by the water pump 46 is discharged to the outside of the outboard motor 1 through the relief valve 72 and the relief channel 71. As a result, it is possible to prevent the internal pressure of the water intake channel 44 and the water jacket 45 from excessively increasing.

In a case where the operation of the engine unit 2 stops (when the use of the outboard motor 1 is completed), it is necessary to discharge the remaining water to the outside of the outboard motor 1 after the operation stop of the engine unit 2. In order to discharge the remaining water, it is necessary to exchange the remaining water with the air by introducing the air to the inside of the water intake channel 44 or the water jacket 45. According to an embodiment of the invention, the second valve 62 is switched from the closed position to the open position after the operation stop of the engine unit 2. If the second valve 62 is switched from the closed position to the open position, the outlet port 452 of the water jacket 45 of the engine unit 2 communicates with the external air through the second channel 42. For this reason, the air can flow to the inside from the outlet port 452 of the water jacket 45 of the engine unit 2 through the air intake portion 47 and the second channel 42. In addition, the remaining water is discharged to the outside of the outboard motor 1 through the water intake channel 44 and the water intake port 43 by the gravity of the remaining water and is exchanged with the air flowing through the air intake portion 47 and the second channel 42. In this configuration, since the remaining water and the air are rapidly exchanged, it is possible to rapidly discharge the remaining water to the outside of the outboard motor 1. Therefore, it is possible to shorten the time necessary to discharge the remaining water.

That is, if the temperature of the remaining water (coolant) decreases, and the first valve 61 has the closed position, the outlet port 452 of the water jacket 45 of the engine unit 2 is closed. For this reason, if the second channel 42 is not provided, the exchange between the remaining water and the air is performed through the water intake port 43 and the water intake channel 44. In this case, since the flow direction of the discharged remaining water is opposite to the flow direction of the introduced air, the remaining water and the air hinder each other between the discharging and introducing flows. In addition, the water pump 46 provided in the water intake channel 44 serves as a resistance in the discharge of the remaining water or the introduction of the air. For this reason, in this configuration, it takes a long time to discharge the remaining water.

In contrast, according to the embodiment of the invention, the outlet port 452 of the water jacket 45 of the engine unit 2 communicates with the external air through the second channel 42 (opened to the atmosphere). The outlet port 452 of the water jacket 45 is located higher than the water jacket 45, the water intake channel 44, and the water intake port 43. Therefore, when the remaining water is discharged by the gravity, the air is introduced from the outlet port 452 of the water jacket 45. In this configuration, since the remaining water and the air do not hinder each other between the discharging and introducing flows, the remaining water and the air rapidly are exchanged with each other. Therefore, it is possible to rapidly discharge the remaining water and shorten the time necessary to discharge the remaining water.

The second channel 42 also serves as a flushing water discharge channel in the event of flushing. In the event of flushing, the second valve 62 is set to the open position, and the water intake port 43 provided in the gear housing 13 is blocked. A flushing operator or the like removes the lid member 7 provided in the flushing water injection port 75 and injects the flushing water from the flushing water injection port 75. The injected flushing water flows to the inside of the water jacket 45 of the engine unit 2 through the flushing water channel 73 and the water intake channel 44. The flushing water flowing through the water jacket 45 is discharged to the outside of the outboard motor 1 through the valve housing 5, the second channel 42, and the air intake portion 47. Note that, if the temperature of the injected flushing water is lower than a predetermined level, the first valve 61 maintains the closed position. For this reason, in this case, the flushing water discharged from the outlet port 452 of the water jacket 45 of the engine unit 2 is not allowed to flow to the first channel 41. In this regard, by setting the second valve 62 in the open position in the event of flushing, the injected flushing water is discharged to the outside of the outboard motor 1 through the second channel 42. In this manner, the second channel 42 serves as both the air introduction channel in the remaining water discharge operation and the flushing water discharge channel in the flushing operation.

Figure 4:
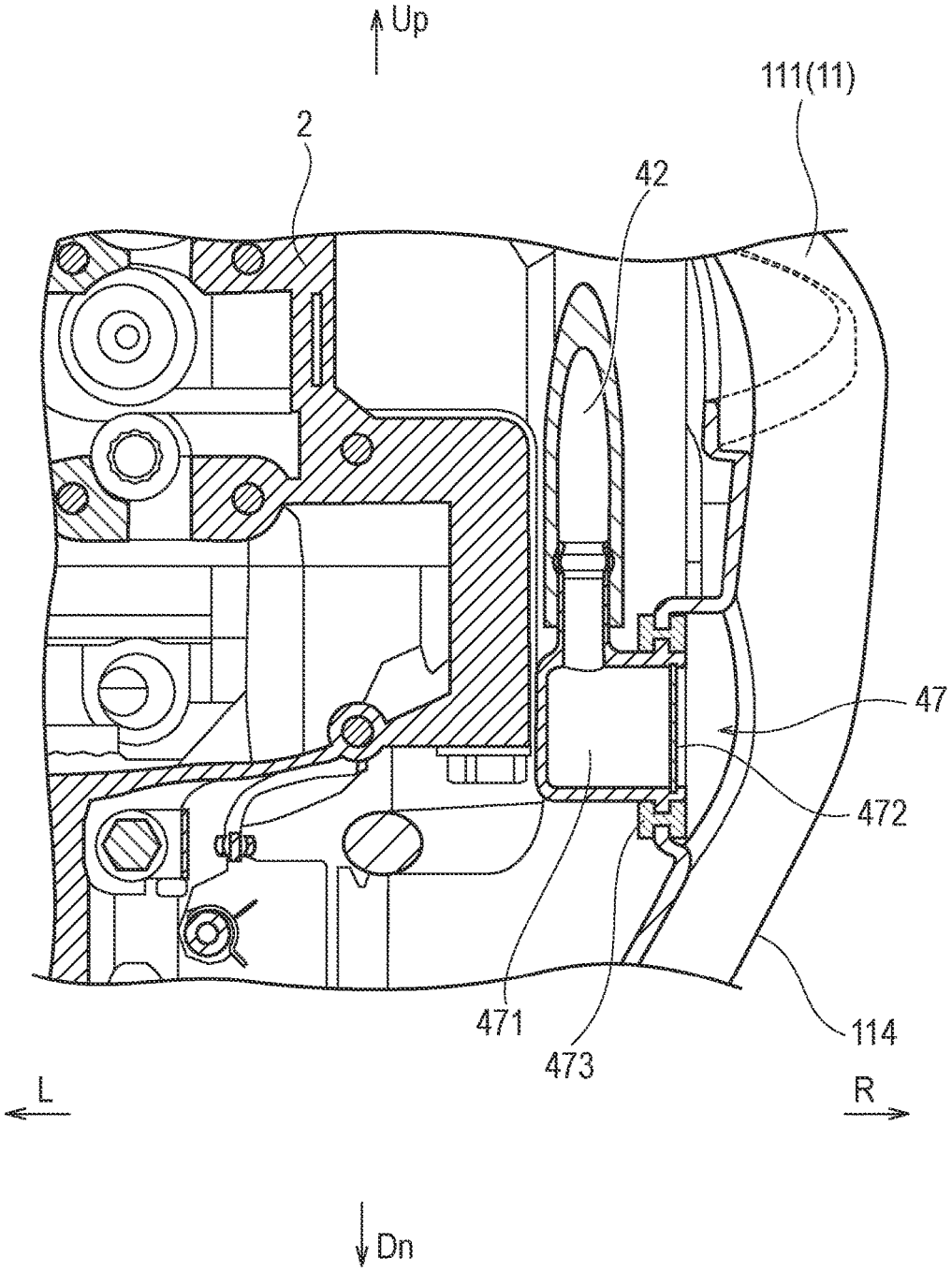
FIG. 4 is a cross-sectional view schematically illustrating an exemplary configuration of an air intake portion.

Here, an exemplary configuration of the air intake portion 47 will be described with reference to FIG. 4. FIG. 4 is a cross-sectional view schematically illustrating an exemplary configuration of the air intake portion 47. The upstream-side end of the air flow of the second channel 42 is connected to the air intake portion 47 and communicates with the external air through the air intake portion 47 (opened to the atmosphere). The air intake portion 47 is provided in a position that is not submerged during sailing of the outboard motor 1. According to an embodiment of the invention, the air intake portion 47 is provided, for example, on the side face of the engine cover 11 (in the side panel 114 of the lower engine cover 111) (refer to FIG. 1).

In the configuration in which a hose or tube is employed in the second channel 42, a union 471 where a hose or tube can be connected may be employed in the air intake portion 47. As illustrated in FIG. 4, an opening is provided on a side face of the engine cover 11, and the union 471 is installed in this opening using a water stop grommet 473. In addition, the upstream-side end of the air flow of the second channel 42 is connected to the union 471.

Furthermore, a mesh plate 472 is provided in the union 471 to prevent a foreign object from intruding from the outside. In addition, the air intake portion 47 also serves as a drain port for discharging the flushing water to the outside of the outboard motor 1 in the event of flushing. Note that the configuration of the air intake portion 47 is not limited to the aforementioned one. The air intake portion 47 may have a configuration that allows the upstream-side end of the air flow of the second channel 42 to communicate with the external air (opened to the atmosphere).

Figure 5:
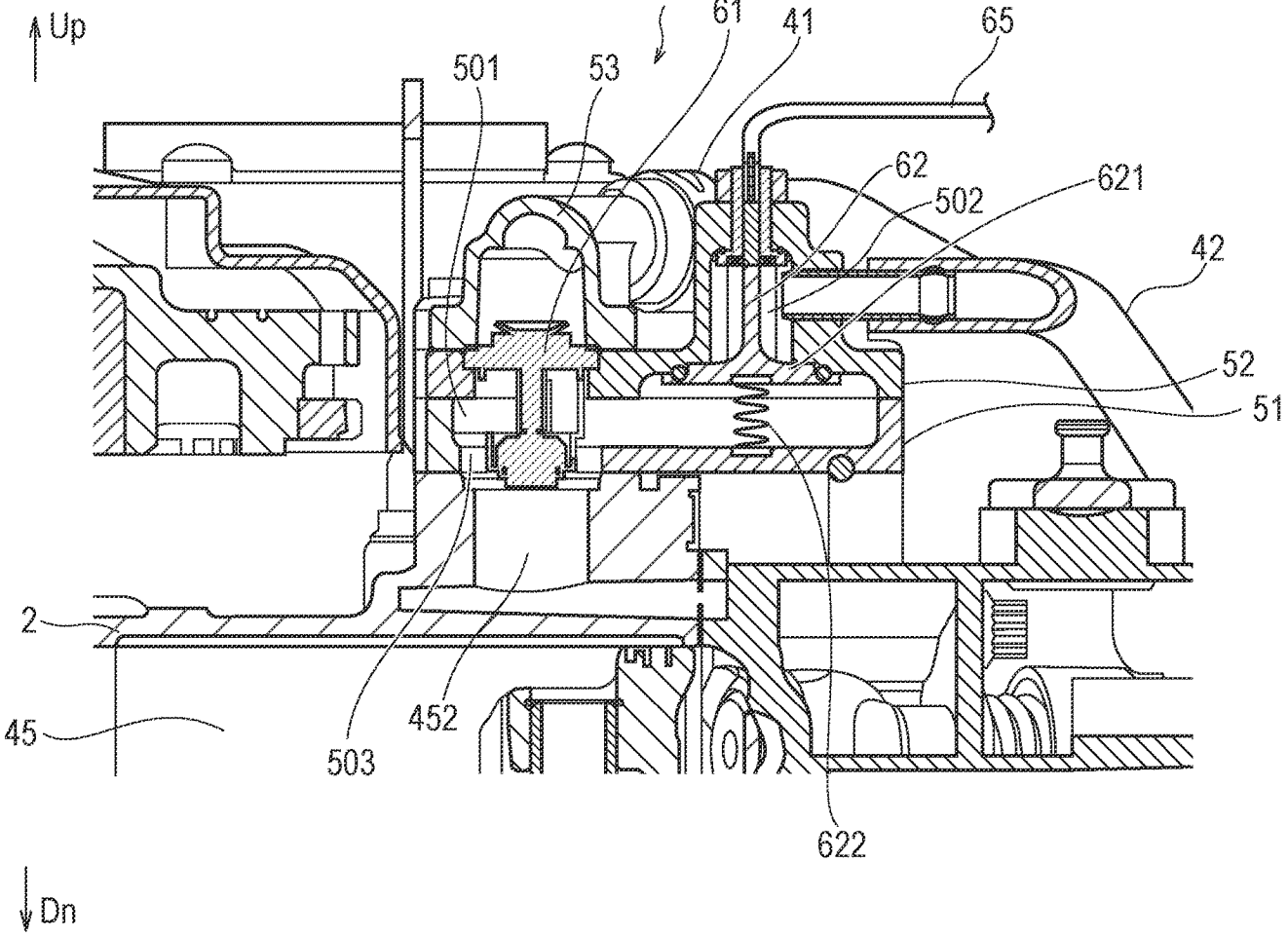
FIG. 5 is a cross-sectional view schematically illustrating an exemplary configuration of a valve housing.

Next, exemplary configurations of the valve housing 5 and the first valve 61 will be described with reference to FIG. 5. FIG. 5 is a cross-sectional view schematically illustrating an exemplary configuration of the valve housing 5. The valve housing 5 connects the outlet port 452 of the water jacket 45 of the engine unit 2 and the first and second channels 41 and 42 to each other. In other words, the valve housing 5 is interposed between the outlet port 452 of the water jacket 45 and the first and second channels 41 and 42. The outlet port 452 of the water jacket 45 is provided in the upper side of the cylinder block 22, and the valve housing 5 is overlappingly provided over the outlet port 452 of the water jacket 45.

As illustrated in FIG. 5, the inside of the valve housing 5 is provided with a space serving as a coolant or air channel. In addition, the valve housing 5 is provided with a first connecting portion 501 where an upper valve housing 53 is installed, a second connecting portion 502 where the second channel 42 is connected, and a third connecting portion 503 where the outlet port 452 of the water jacket 45 is connected. The first, second, and third connecting portions 501, 502, and 503 have communicating holes (openings) that allow internal and external spaces to communicate with each other. In addition, the valve housing 5 houses the first and second valves 61 and 62.

The valve housing 5 has, for example, a lower valve housing 51, a middle valve housing 52, and an upper valve housing 53. The lower valve housing 51 is provided in the lowermost side (closest to the cylinder block 22). The middle valve housing 52 is overlappingly provided over the lower valve housing 51. The upper valve housing 53 is overlappingly provided over the middle valve housing 52.

The lower valve housing 51 has a box shape opened in the upper side, and the third connecting portion 503 is provided on the bottom surface of the lower valve housing 51. Here, for example, an opening (through-hole) is employed as the third connecting portion 503. In addition, the lower valve housing 51 is overlappingly provided over the cylinder block 22 to allow the third connecting portion 503 to communicate with the outlet port 452 of the water jacket 45. For this reason, the coolant or the flushing water discharged from the outlet port 452 of the water jacket 45 flows to the inside of the valve housing 5 through the third connecting portion 503.

The middle valve housing 52 has a box shape opened in the lower side (lid shape), and the first and second connecting portions 501 and 502 are provided on the upper surface of the middle valve housing 52. An opening (through-hole) penetrating in the vertical direction is employed as the first connecting portion 501. The second connecting portion 502 has a cylindrical shape protruding upward from the upper surface of the middle valve housing 52 and is internally provided with an opening (space) opened in the lower side.

In addition, the upper valve housing 53 is provided over the first connecting portion 501, and the second channel 42 is connected to the second connecting portion 502. For example, if a hose or tube is employed in the second channel 42, a union where the hose or tube can be connected is provided in the second connecting portion 502. In this case, the internal space of the second connecting portion 502 communicates with the hose or tube as the second channel 42 through the union.

The upper valve housing 53 has a cylindrical shape opened in the lower side. In addition, the upper valve housing 53 is overlappingly provided over the middle valve housing 52 to cover the opening of the first connecting portion 501. The upper valve housing 53 has a configuration where the first channel 41 can be connected. For example, if a hose or tube is employed in the first channel 41, a union where the hose or tube can be connected is provided in the upper valve housing 53. In this case, the internal space of the upper valve housing 53 communicates with the hose or tube as the first channel 41 through the union.

The first valve 61 is housed in the valve housing 5 so as to open or close the opening as the first connecting portion 501. The first valve 61 has the closed position when the coolant or the flushing water of the valve housing 5 has a temperature lower than a predetermined level. The first valve 61 has the open position when the temperature of the coolant or the flushing water is equal to or higher than the predetermined level. If the first valve 61 has the closed position, the opening as the first connecting portion 501 is closed, so that the coolant or the flushing water is not allowed to flow between the valve housing 5 and the first channel 41. If the first valve 61 has the open position, the opening as the first connecting portion 501 is not blocked, so that the coolant is allowed to flow between the valve housing 5 and the first channel 41.

In this configuration, if the warm-up operation of the engine unit 2 is not completed, the first valve 61 is maintained in the closed position. If the warm-up operation of the engine unit 2 is completed, the first valve 61 has the open position. In addition, if the engine unit 2 stops, and the temperature of the coolant is lower than a predetermined level, the first valve 61 returns from the open position to the closed position. Note that, for example, a thermo-valve (thermostat) is employed in the first valve 61 as described above.

Next, an exemplary configuration of the second valve 62 will be described. The second valve 62 is housed in the valve housing 5 such that the second connecting portion 502 can be opened or closed. If the second valve 62 has the closed position, the second connecting portion 502 is blocked, so that the air or the flushing water is not allowed to flow between the valve housing 5 and the second channel 42. If the second valve 62 has the open position, the second connecting portion 502 is not blocked, so that the air or the flushing water can flow between the valve housing 5 and the second channel 42. According to the embodiment of the invention, the first to fourth exemplary configurations are applied to the second valve 62 as described below.

In the first exemplary configuration, a manual type normally closed valve is applied to the second valve 62. In this example, the second valve 62 has the closed position (maintains the closed position) in a case where a drain manipulation is not performed for the drain manipulation portion 64. While the drain manipulation is performed for the drain manipulation portion 64, the second valve 62 has the open position.

The second valve 62 has a valve member 621 and a biasing member 622. The valve member 621 is reciprocatably housed in the valve housing 5 to open or close the second connecting portion 502. For example, as the valve member 621 moves upward, an edge portion of the valve member 621 makes contact with the edge portion of the opening of the second connecting portion 502. Meanwhile, as the valve member 621 moves downward, a gap is formed between the valve member 621 and the edge portion of the opening of the second connecting portion 502.

A state in which the valve member 621 moves upward, and the edge portion of the valve member 621 makes contact with the edge portion of the opening of the second connecting portion 502 is the closed position of the second valve 62. If the second valve 62 has the closed position, the channel from the first connecting portion 501 to the second connecting portion 502 is disconnected by the valve member 621 of the second valve 62, so that the air or the flushing water is not allowed to flow between the valve housing 5 and the second channel 42. The second valve 62 has a biasing member 622 that biases the valve member 62 upward (toward the second connecting portion 502), so that the second valve 62 is maintained in the closed position by virtue of the biasing force of the biasing member 622. Note that a specific configuration the biasing member 622 is not particularly limited as long as it can bias the valve member 621 upward. For example, various types of springs such as a coil spring or a plate spring or an elastic member such as rubber may be employed.

A state in which the valve member 621 moves downward, and a gap is formed between the valve member 621 and the edge portion of the opening of the second connecting portion 502 is the open position of the second valve 62. If the second valve 62 has the open position, the air flowing from the air intake portion 47 to the second channel 42 can flow from the outlet port 452 of the water jacket 45 to the inside through the second connecting portion 502, this gap, and the third connecting portion 503. In addition, the flushing water flowing from the third connecting portion 503 to the inside of the valve housing 5 can flow to the second connecting portion 502 through this gap and the second connecting portion 502. The valve member 621 of the second valve 62 is configured such that it can be pressed downward (inward) from the outside of the valve housing 5. For example, a control wire 65 is connected to the second connecting portion 502 of the valve housing 5. In addition, as the control wire 65 is pressed, the valve member 621 is pressed down by the control wire 65 to move downward, and the second valve 62 has the open position. Note that, if the valve member 621 is not pressed down by the control wire 65, the second valve 62 maintains the closed position by virtue of the biasing force of the biasing member 622.

Figure 6:
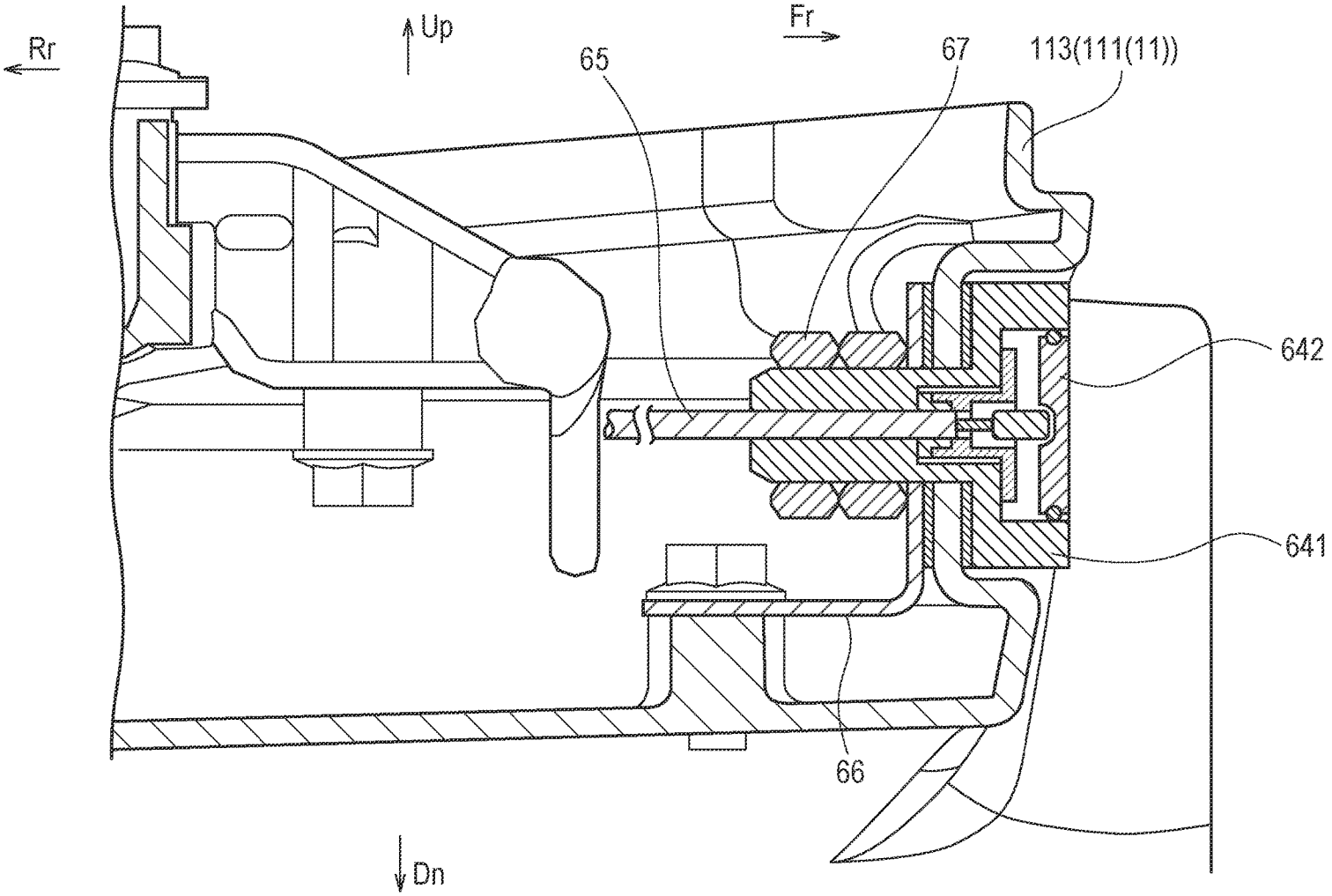
FIG. 6 is a cross-sectional view schematically illustrating an exemplary configuration of a drain manipulation portion.

Here, an exemplary configuration of the drain manipulation portion 64 for performing the drain manipulation will be described with reference to FIG. 6. FIG. 6 is a cross-sectional view schematically illustrating an exemplary configuration of the drain manipulation portion 64 for performing the drain manipulation. Note that the drain manipulation portion 64 is provided in the front panel 113 of the lower engine cover 111 (that is, on the front face of the engine cover 11) as described above (refer to FIG. 2).

As illustrated in FIG. 6, the front panel 113 of the lower engine cover 111 is provided with an opening, and the drain manipulation portion 64 is fitted to this opening. The drain manipulation portion 64 has a cylindrical push button holder 641 and a push button 642 provided reciprocatably in the inner circumferential side of the push button holder 641. In addition, the cylindrical push button holder 641 is detachably installed in a stay 66 or the like provided inside the lower engine cover 111 using a nut 67 and the like. An end of the control wire 65 is housed in the push button holder 641.

If the push button 642 is pushed from the outside, the control wire 65 is pushed by the push button 642 and moves. The other end of the control wire 65 is connected to the second connecting portion 502 of the valve housing 5 as described above, so that the valve member 621 of the second valve 62 can be pressed down. For this reason, if the push button 642 of the drain manipulation portion 64 is pushed, the valve member 621 of the second valve 62 is pressed down by virtue of the movement of the control wire 65, and the second valve 62 has the open position. If the force of pushing the push button 642 is removed, the valve member 621 of the second valve 62 has the closed position by virtue of the biasing force of the biasing member 622. In addition, the control wire 65 is pressed by the valve member 621, and the push button 642 is extruded by the control wire 65, so that the control wire 65 returns to its original position prior to the pushing.

In this configuration, the second valve 62 has the open position while the push button 642 of the drain manipulation portion 64 is pushed. Meanwhile, the second valve 62 has the closed position while the push button 642 is not pushed. In this manner, the second valve 62 normally has the closed position. However, the second valve 62 has the open position when the push button 642 is pushed. That is, a manual type normally closed valve is employed in the second valve 62. In addition, the manipulation of pushing the push button 642 of the drain manipulation portion 64 is the drain manipulation for discharging the remaining water. While the drain manipulation is performed, the second valve 62 has the open position so that the remaining water is discharged to the outside of the outboard motor 1 as described above. Therefore, a user (ship operator or the like) can set the second valve 62 to the open position and discharge the remaining water by manipulating the drain manipulation portion 64.

Note that the configurations of the second valve 62 and the drain manipulation portion 64 are not limited to those described above. In short, the normally closed valve is employed in the second valve 62, and the second valve 62 may have any configuration as long as the second valve 62 has the open position while the drain manipulation portion 64 is manipulated.

The drain manipulation portion 64 is provided in the front panel 113 that forms a front face of the engine cover 11. According to an embodiment of the invention, the engine cover 11 has a lower engine cover 111 located in the lower side and the upper engine cover 112 located in the upper side. In addition, the drain manipulation portion 64 is provided in the front panel 113 that forms a front face of the lower engine cover 111. Since a user (ship operator) typically controls the outboard motor 1 in the front side of the outboard motor 1, if the drain manipulation portion 64 is provided in this location, a user can easily manipulate the drain manipulation portion 64.

In the second exemplary configuration, an electromagnetic type normally closed valve is employed in the second valve 62. In the second exemplary configuration, similar to the first exemplary configuration, the second valve 62 has the closed position while the drain manipulation is not performed. Meanwhile, the second valve 62 has the open position while the drain manipulation is performed.

Figure 7:
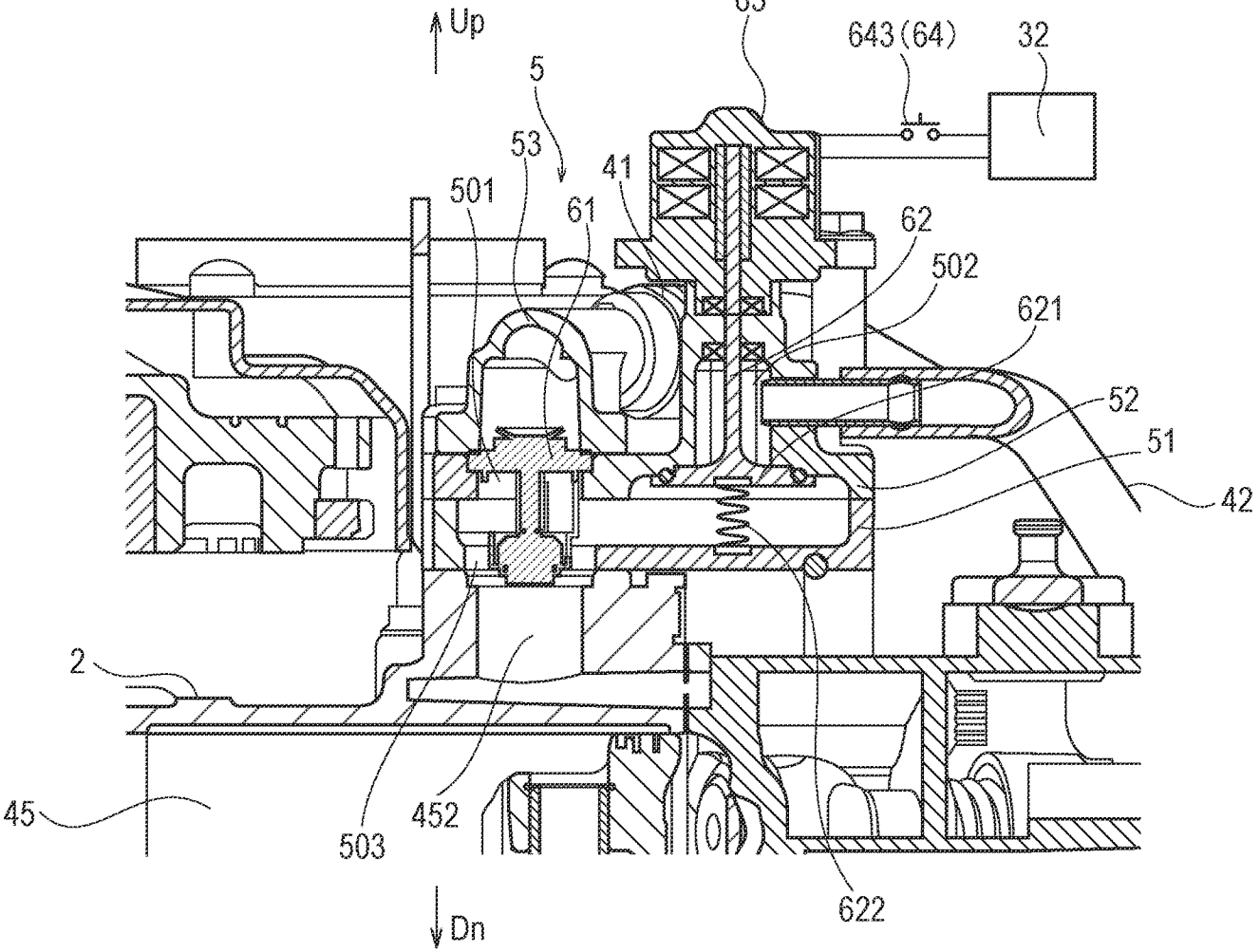
FIG. 7 is a diagram schematically illustrating a second exemplary configuration of the second valve.

FIG. 7 is a diagram schematically illustrating a second exemplary configuration of the second valve 62. As illustrated in FIG. 7, an electromagnetic type normally closed valve is employed in the second valve 62. Note that the valve member 621 and the biasing member 622 of the second valve 62 may have configurations similar to those of the first exemplary configuration. In addition, the valve housing 5 is provided with a solenoid 63 for setting the second valve 62 in the open position, and the valve member 621 is connected to the solenoid 63. In addition, if the solenoid 63 is electrically conducted, the solenoid 63 presses down the valve member 621 resisting to the biasing force of the biasing member 622, so that the second valve 62 has the open position. If the solenoid 63 is not electrically conducted, the valve member 621 is forcibly lifted up by the biasing force of the biasing member 622, and the second valve 62 has the closed position. In this manner, in the second exemplary configuration, the electromagnetic type normally closed valve is employed in the second valve 62. The second valve 62 has the closed position while the solenoid 63 is not electrically conducted. Meanwhile, the second valve 62 has the open position while the solenoid 63 is electrically conducted.

As illustrated in FIG. 7, the solenoid 63 and the battery 32 are connected to each other, and a contact switch 643 is provided between the solenoid 63 and the battery 32 to serve as the drain manipulation portion 64. This contact switch 643 may include a switch (so-called A-contact switch) in which the contact points are not connected while the switch is not manipulated, and the contact points are connected only while the switch is manipulated. In this configuration, the second valve 62 has the closed position while the contact switch 643 serving as the drain manipulation portion 64 is not manipulated. Meanwhile, the second valve 62 has the open position while the contact switch 643 is manipulated. In this manner, in the second exemplary configuration, the manipulation of the contact switch 643 is the drain manipulation. In addition, while the drain manipulation is performed, the second valve 62 has the open state, so that the remaining water is discharged. A user can discharge the remaining water by setting the second valve 62 in the open position by manipulating this contact switch 643.

Note that the configuration of the contact switch 643 as the drain manipulation portion 64 is not particularly limited, but various types of contact switches known in the art may be employed. In short, any configuration may be employed in the contact switch 643 as long as the solenoid 63 is not electrically conducted, and the second valve 62 is maintained in the closed position while the manipulation is not performed. Meanwhile, the solenoid 63 is electrically conducted, and the second valve 62 has the open position only while the manipulation is performed. Similarly, in the second exemplary configuration, the drain manipulation portion 64 is preferably provided in the front panel 113 of the lower engine cover 111.

Figure 8:
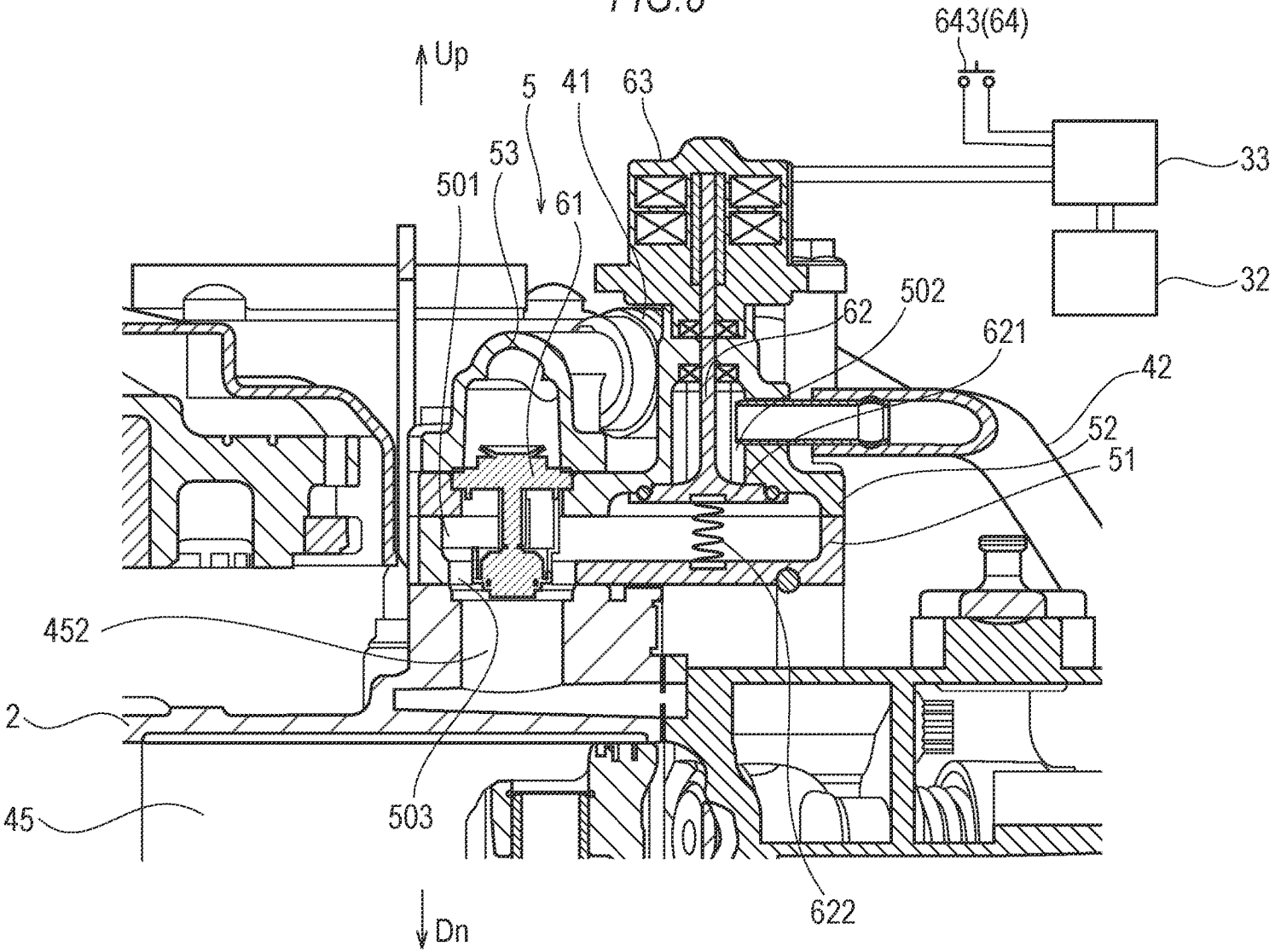
FIG. 8 is a circuit diagram schematically illustrating another exemplary circuit configuration for setting the second valve in an open position.

A circuit for setting the second valve 62 in the open position may have the following configuration. FIG. 8 is a circuit diagram schematically illustrating another example of the circuit configuration for setting the second valve 62 in the open position. As illustrated in FIG. 8, both the solenoid 63 and the contact switch 643 serving as the drain manipulation portion 64 are connected to the ECU 33. The ECU 33 can drive the solenoid 63 and detect a state (ON or OFF) of the contact switch 643 serving as the drain manipulation portion 64. The ECU 33 starts electric conduction to the solenoid 63 to set the second valve 62 in the open position when it is detected that the contact switch 643 serving as the drain manipulation portion 64 is in ON. In addition, for a predetermined time after the drain manipulation portion 64 is in ON (or after the electric conduction of the solenoid 63 starts), the ECU 33 continuously electrically conducts the solenoid 63 regardless of the state (ON or OFF) of the contact switch 643 serving as the drain manipulation portion 64. In addition, the ECU 33 stops the electric conduction to the solenoid 63 after a predetermined time elapses. In this configuration, the second valve 62 is maintained in the open position until the remaining water is discharged even when a user does not continuously perform the manipulation on the drain manipulation portion 64. In addition, the second valve 62 automatically returns to the closed position after the remaining water is discharged.

Note that a computer program for executing such a control is stored in the ROM of the computer of the ECU 33 in advance. In addition, the CPU of the computer of the ECU 33 reads and executes this computer program from the ROM by using the RAM as a work area. As a result, the operations described above are implemented. Note that a predetermined time for maintaining the second valve 62 in the open position is not particularly limited. This predetermined time is set depending on the time necessary to discharge the remaining water and is stored in the ROM in advance.

In the third exemplary configuration, an electromagnetic type normally closed valve is employed in the second valve 62. In the third exemplary configuration, the second valve 62 has the closed position during the operation of the engine unit 2. Meanwhile, when the stop manipulation of the engine unit 2 is performed, the second valve 62 has the open position for a predetermined time. Note that the second valve 62 may have the configuration similar to the second exemplary configuration. In addition, the circuit configuration similar to that of FIG. 8 may be employed except that the contact switch 643 serving as the drain manipulation portion 64 is not provided.

The ECU 33 maintains the second valve 62 in the closed position during the operation of the engine unit 2. In addition, the ECU 33 switches the second valve 62 to the open position if the stop manipulation of the engine unit 2 is detected. In addition, the ECU 33 returns the second valve 62 to the closed position if a predetermined time elapses after the switching to the open position. As the stop manipulation of the engine unit 2, for example, a manipulation for turning off the ignition switch may be employed although not shown in the drawings. Note that the generator 31 generates electricity during the operation of the engine unit 2 and does not generate electricity as the engine unit 2 stops. Therefore, after the stop manipulation for the engine unit 2 is performed, and the engine unit 2 stops in practice, the second valve 62 is switched to the open position by driving the solenoid 63 using the power of the battery 32.

Figure 9:
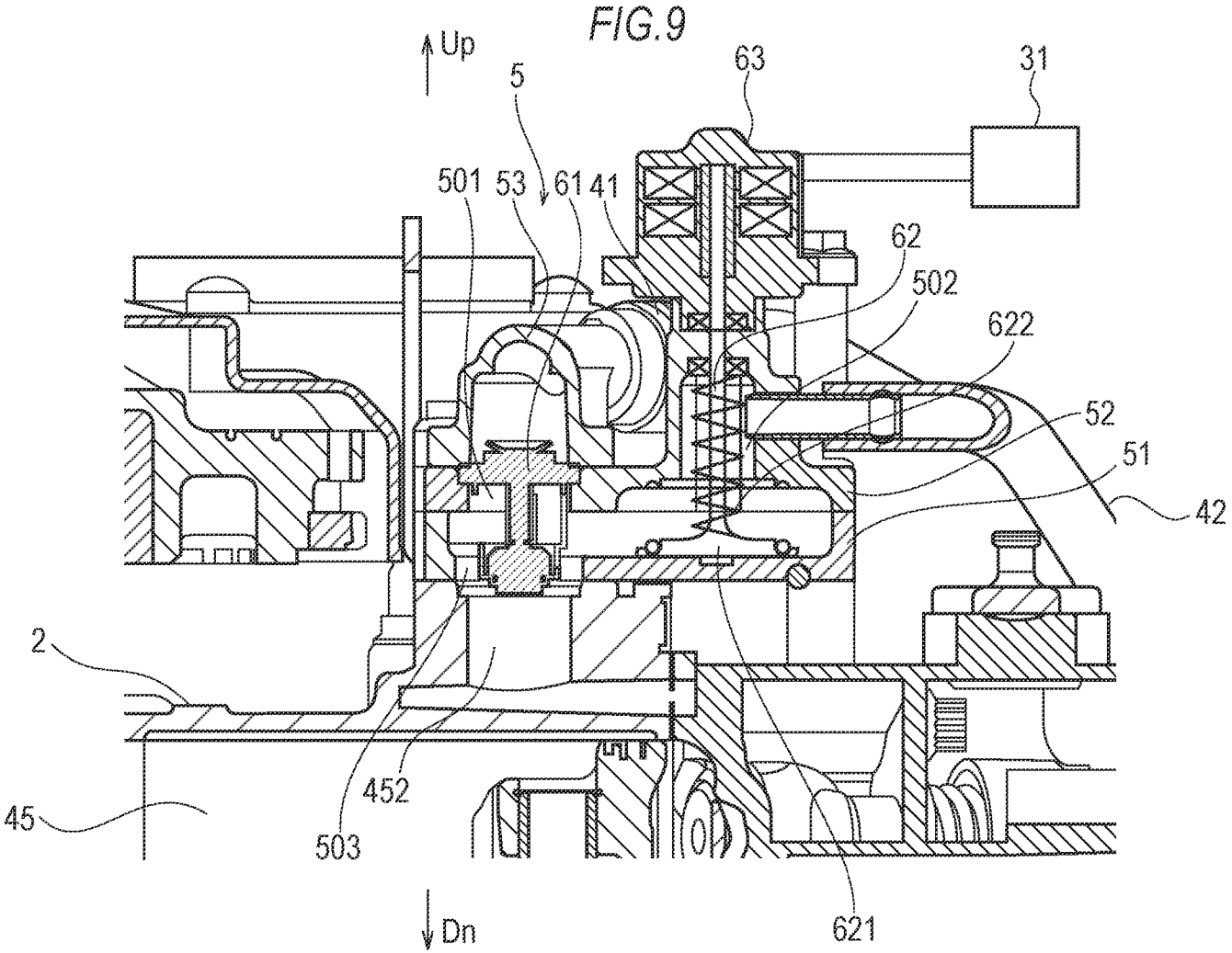
FIG. 9 is a schematic diagram collectively illustrating an exemplary configuration of the second valve and an exemplary circuit configuration for driving the second valve.

In the fourth exemplary configuration, an electromagnetic type normally opened valve is employed in the second valve 62. In the fourth exemplary configuration, the second valve 62 has the closed position during the operation of the engine unit 2 and has the open position during the stop of the engine unit 2. FIG. 9 is a schematic diagram collectively illustrating an exemplary configuration of the second valve 62 and an exemplary circuit configuration for driving the second valve 62. As illustrated in FIG. 9, the second valve 62 of the fourth exemplary configuration is different from the second valve 62 of the second or third exemplary configuration in that the biasing member 622 biases the valve member 621 downward. Other elements may have similar configurations. In the fourth exemplary configuration, the biasing member 622 biases the valve member 621 of the second valve 62 downward. As the solenoid 63 is electrically conducted, the valve member 621 moves upward so that the second valve 62 has the closed position. While the solenoid 63 is not electrically conducted, the second valve 62 is pressed down by the biasing force of the biasing member 622 so as to have the open position.

As illustrated in FIG. 9, the solenoid 63 that drives the second valve 62 is connected to the generator 31 of the outboard motor 1, so that it has an electrically conducted state by the power generated from the generator 31 during the operation of the generator 31. Since the generator 31 of the outboard motor 1 generates electricity by virtue of rotation of the crankshaft 25 of the engine unit 2, the solenoid 63 is maintained in the electrical conduction, and the second valve 62 has the closed position during the operation of the engine unit 2 (while the crankshaft 25 is rotated). For this reason, during the use of the outboard motor 1 such as sailing, the coolant fed to the water jacket 45 of the engine unit 2 flows through the first valve 61 of the valve housing 5 and the first channel 41 and is discharged to the outside of the outboard motor 1. If the engine unit 2 stops after the use of the outboard motor 1, the electrical conduction to the solenoid 63 stops. Therefore, the second valve 62 has the open position. For this reason, if the engine unit 2 stops, the remaining water is automatically discharged even when a user does not perform the manipulation for discharging the remaining water. For this reason, in the fourth exemplary configuration, the drain manipulation portion 64 may not be provided.

Figure 10:
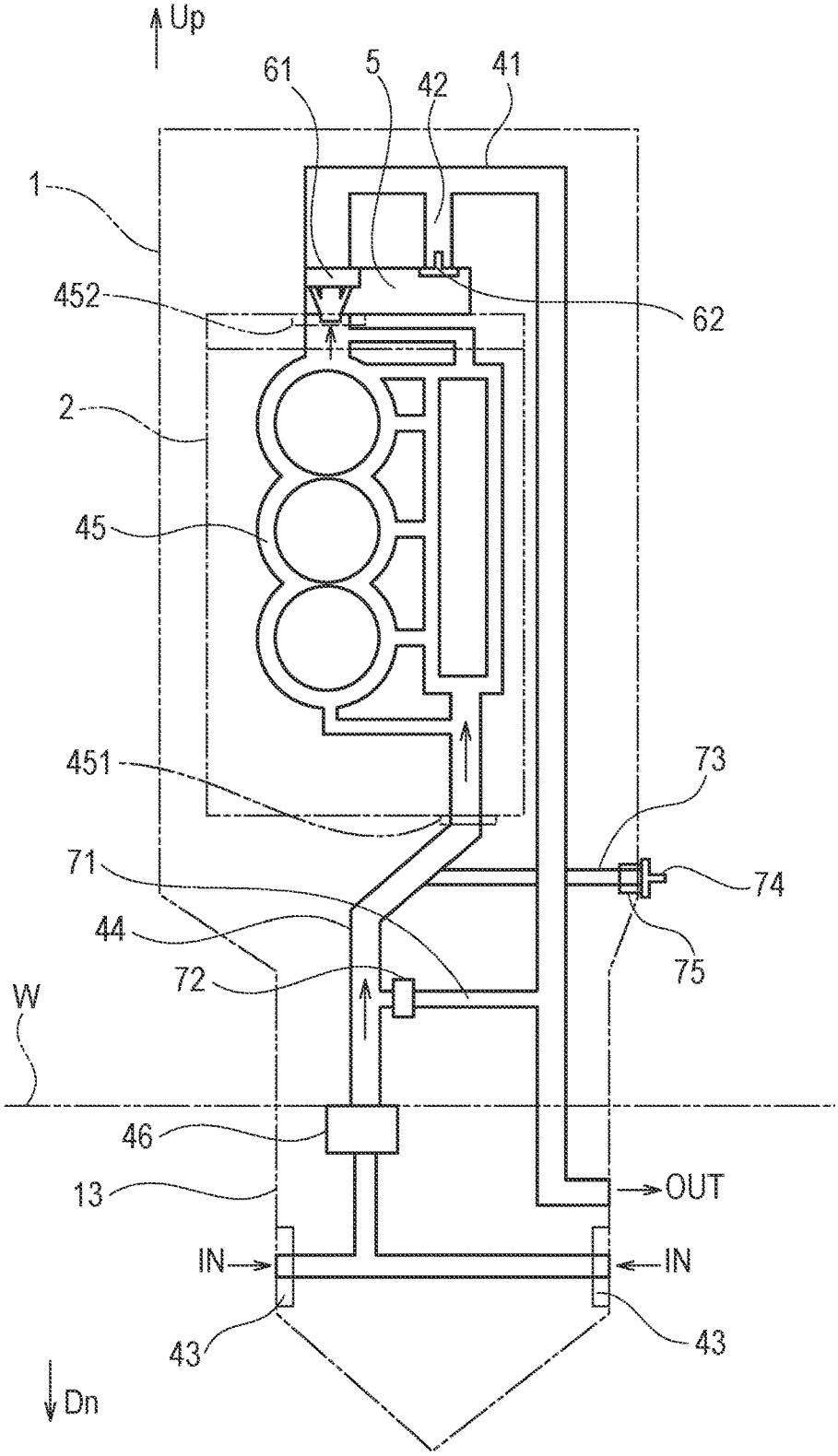
FIG. 10 is a diagram schematically illustrating a second exemplary configuration of the second channel.

Next, a second exemplary configuration of the cooling system of the engine unit 2 will be described with reference to FIG. 10. FIG. 10 is a diagram schematically illustrating the second exemplary configuration of the cooling system of the engine unit 2 and is corresponding to FIG. 3. The valve housing 5, the first valve 61, and the second valve 62 may be similar to those of the first exemplary configuration. Note that like reference numerals denote like elements as in the first exemplary configuration (illustrated in FIG. 3), and they will not be described repeatedly.

As illustrated in FIG. 10, one end of the second channel 42 is connected to the second connecting portion 502 of the valve housing 5, and the other end is connected to the downstream side of the coolant flow of the first channel 41 relative to the first valve 61. That is, the second channel 42 forms a channel for bypassing the first valve 61. In this configuration, if the second valve 62 has the open position even when the first valve 61 has the closed position, the outlet port 452 of the water jacket 45 of the engine unit 2 communicates with the external air (opened to the atmosphere) through the valve housing 5, the second channel 42, and the first channel 41. For this reason, when the remaining water is discharged, the air is introduced into the water jacket 45 of the engine unit 2 through the first channel 41 and the second channel 42. In addition, during the flushing, the flushing water is discharged from the water jacket 45 to the outside of the outboard motor 1 through the second channel 42 and the first channel 41. In this manner, also in the second exemplary configuration, it is possible to obtain the same effects as those described above.

Note that the configurations or operations of the first and second valves 61 and 62 may be similar to those of the first exemplary configuration of the cooling system of the engine unit 2. In addition, the second valve 62 may be similar to any one of the second valves 62 of the first to fourth exemplary configurations.

While embodiments of the present invention have been described in details with reference to the accompanying drawings hereinbefore, the aforementioned embodiments are intended to show specific examples for implementing the present invention. The technical scope of the present invention is not limited to the aforementioned embodiments. Various changes and modifications may be possible without departing from the spirit and scope of the invention, and they are also construed as being within the technical scope of the invention.

The present invention is a technology effective to an outboard motor. According to the present invention, it is possible to rapidly discharge the coolant remaining in the water jacket of the engine unit to the outside of the outboard motor.

According to the present invention, it is possible to rapidly discharge the coolant remaining in the water jacket after the engine operation stops.

What is claimed is:

1. An outboard motor comprising:

a water jacket provided in a water-cooled engine to allow a coolant to flow through;

a first channel configured to allow a downstream-side end of the coolant flow of the water jacket to communicate with the external air;

a first valve provided between a downstream-side end of the coolant flow of the water jacket and an upstream-side end of the coolant flow of the first channel, the first valve having a closed position when a temperature of the coolant is lower than a predetermined level and having an open position when the temperature of the coolant is equal to or higher than the predetermined level;

a second channel configured to allow an upstream side of the coolant flow of the first valve to communicate with the external air; and a second valve configured to open or close the second channel.

2. The outboard motor according to claim 1, wherein the second channel connects an upstream side of the coolant flow of the first valve and the first channel to each other, and the second channel allows an upstream side of the coolant flow of the first valve to communicate with the external air through the first channel.

3. The outboard motor according to claim 1, further comprising an engine cover configured to house the water-cooled engine, wherein a drain manipulation portion for manipulating the second valve is provided on a front face of the engine cover.

4. The outboard motor according to claim 3, wherein the second valve is a normally closed valve, the second valve has the open position while the drain manipulation portion is manipulated, and the second valve has the closed position when the drain manipulation portion is not manipulated.

5. The outboard motor according to claim 1, wherein the second valve is a normally closed valve, the second valve has the closed position while the water-cooled engine is operated, the second valve is switched from the closed position to the open position when a stop manipulation for the engine is performed, and the second valve returns to the closed position if a predetermined time elapses after switching to the closed position.

6. The outboard motor according to claim 1, further comprising a generator configured to generate electricity by virtue of a driving force of the water-cooled engine during the operation of the water-cooled engine, wherein the second valve is an electromagnetic type normally opened valve, the second valve has the closed position by power generated by the generator during the operation of the water-cooled engine, and the second valve has the open position while the water-cooled engine stops.

7. The outboard motor according to claim 1, wherein the second channel also serves as a channel for discharging flushing water to flush the water jacket.

* * * * *